US006675019B1

(12) United States Patent
Thomson et al.

(10) Patent No.: US 6,675,019 B1
(45) Date of Patent: Jan. 6, 2004

(54) LOGISTICAL AND ACCIDENT RESPONSE RADIO IDENTIFIER

(76) Inventors: James D. Thomson, 217 Yorkshire Pl., Bellevue, OH (US) 44811; Soheyl C. Salahshour, 2745 Kersdale Rd., Pepper Pike, OH (US) 44124

( * ) Notice: Subject to any disclaimer, the term of this patent is extended or adjusted under 35 U.S.C. 154(b) by 0 days.

(21) Appl. No.: 09/347,838

(22) Filed: Jul. 2, 1999

Related U.S. Application Data

(60) Provisional application No. 60/091,704, filed on Jul. 3, 1998.

(51) Int. Cl.[7] ..... G08G 1/123

(52) U.S. Cl. ..... 455/521; 701/201

(58) Field of Search ..... 455/521, 404, 455/556, 557; 701/201, 204; 340/991, 572.1, 539

(56) References Cited

U.S. PATENT DOCUMENTS 5,448,220 A * 9/1995 Levy ..... 340/10.42
5,648,770 A * 7/1997 Ross ..... 340/988
5,719,771 A * 2/1998 Buck et al. ..... 340/438
6,124,810 A * 9/2000 Segal et al. ..... 340/441
6,212,401 B1 * 4/2001 Ackley ..... 455/556
6,285,868 B1 * 9/2001 LaDue ..... 340/870.02
2001/0044723 A1 * 11/2001 Ikeda et al. ..... 704/260

* cited by examiner

*Primary Examiner*—Nay Maung
*Assistant Examiner*—Nick Corsaro
(74) *Attorney, Agent, or Firm*—Fay, Sharpe, Fagan, Minnich & McKee, LLP

(57) ABSTRACT

An accident response radio identification system is provided for use with vehicles carrying hazardous loads for identifying the loads to safety personnel when the vehicle is involved in an accident. A first communication unit on the motor vehicle is adapted to selectively transmit information describing the hazardous load in response to receiving an activation signal from a remote second communication unit. The second communication unit is adapted to convert the information describing the hazardous load received from the first communication unit into a form intelligible by human safety personnel. In addition, a logistics system is provided for use with a motor for compiling logistical information relating to an accumulated time the motor vehicle is driven. The system includes a memory unit for storing driving log information, a sensor for sensing movement of the vehicle and a control unit for receiving signals from the sensor and converting the signals into vehicle operation information and storing that information in the memory as the driving log information.

12 Claims, 4 Drawing Sheets

LOGISTICAL AND ACCIDENT RESPONSE RADIO IDENTIFIER

CROSS-REFERENCE TO RELATED APPLICATION

This application claims the benefit of U.S. Provisional Application No. 60/091,704, filed Jul. 3, 1998.

BACKGROUND OF THE INVENTION

Roadway accidents involving hazardous loads have caused damage to property and pose a danger to life and limb. A major problem lies in simply identifying the specific load that has spilled. Many times police officers or other safety personnel arrive at the scene of a motor vehicle accident in which a chemical spill has occurred and are unable to readily ascertain what hazardous material has spilled or what precautions should be taken to prevent damage to the environment and loss of human life. Accordingly, it is an object of the present invention to provide an identification system for use with vehicles e.g., trucks, railroad cars, etc., carrying hazardous materials, that enables police officers or other safety personnel to readily ascertain before arriving at the scene of an accident, the type of hazardous material that has spilled and what precautions should be taken. Preferably, the system includes a responder system comprised of a pair of communication units. The first communication unit is preferably disposed on the vehicle carrying the hazardous load and responsive to a radio signal for transmitting information about the vehicle and its load.

Another problem that arises in connection with roadway accidents involving spilled hazardous materials is that the spilled cargo often emits noxious or dangerous fumes. Accordingly, it is a further object of the present invention to provide an identification system that notifies the police officers or safety personnel who arrive at the scene of a motor vehicle accident of the type of dangerous chemicals that have spilled, while the officers are at some safe distance from the actual accident scene. It is a further object of the invention that the responder system is adapted to not only provide an identification of the hazardous chemical that has spilled but also provides the police officers or other safety personnel with a set of specific precautions which should be taken when approaching the vehicle that has been involved in the accident.

The above objectives are achieved in accordance with the present invention by providing a small electronic first communication unit on the vehicle transporting the hazardous load. The first communication unit is adapted to transmit the name or code of the hazardous material carried by the vehicle as well as other pertinent information relevant to the safety of the police officers or other safety personnel that arrive at the accident scene. Information relating to the carrier and a contact person is also selectively transmitted from the first communication unit.

The first communication unit located on the vehicle transponder is selectively activated by a second communication unit carried by the police officer or safety personnel. To that end, the first communication unit on the motor vehicle acts as a transponder for receiving an activation signal initiated by safety personnel using the second communication unit and, in response thereto, generates a predetermined response transmitting information from the transponder to the second communication unit. The second communication unit is adapted to receive the information from the transponder and convert the information into a form intelligible to humans such as a display of the information on a screen or in the form of an audible signal using a speaker.

In accordance with one aspect of the invention, the second communication unit carried by the police officer or safety personnel includes a database that associates names or codes of hazardous materials with information regarding precautionary measures to be taken with each of the hazardous materials listed in the database. In that way, the first communication unit on the motor vehicle need only transmit a code associated with the hazardous material whereupon the second communication unit receiving the code can readily access a lookup table in the database to derive information regarding the manner in which the hazardous material spill is to be addressed. This information is vital to prevent damage to the environment and to save life or limb of the police or safety officer, driver or passenger in the vehicle, or residents in the area local of the accident scene.

In addition, the second communication unit in accordance with another aspect of the invention includes a phone, preferably a cellular telephone, for use by the safety personnel to transmit information and reports of the spill to Hazmat, EPA, DOT, etc. The phone is of course usable to contact individuals based on names retrieved from the database so that technical information regarding the manner in which the spill is to be handled can be easily obtained if necessary by personnel having special qualifications, knowledge or experience.

Many roadway accidents involving hazardous loads can be attributed to driver fatigue. Typically, truck accidents occur because the driver is tired or sleepy due to the number of hours driven. To overcome this problem, federal laws have been imposed that limit the number of hours a driver can work behind the wheel on the highway. In order to establish a record of hours driven, the current federal law requires the driver to maintain and produce when asked, a log book of his time on the road.

Accordingly, in accordance with another embodiment of the invention, the transponder system is adapted to automatically establish a record of motor vehicle movement activity. An object of this embodiment is to accurately and automatically log the number of hours a vehicle is driven. A further object is to make the process of maintaining or compiling the federally mandated log book, and producing the log book for inspection when required, simpler and easier for the driver. A further object of the invention is for the transponder to completely fill out or construct the log book requirement automatically without driver intervention.

The law that requires drivers to maintain a log book of vehicle activity has not totally eliminated the problems of tired or sleepy drivers on the highway, however. Many drivers ignore the log book requirement in part and therefore do not accurately compile information that accurately reflects driving time. Therefore, inspections of log books that were falsified or sloppily maintained therefore do not always result in ejecting over-driven operators from the highway. Accordingly, it is a further object of the invention to ensure that the logs are accurately prepared and insulated from driver tampering.

Another problem associated with the driving record log books, is the long period of time it usually takes for law enforcement or regulatory officers to inspect the log during routine vehicle stops to ensure that the driver has properly produced the log record and has not driven over the allowed hours. Accordingly, it is a further object of the invention to enable law enforcement officials and regulatory personnel to quickly and easily obtain information regarding the number of hours driven by the driver of a vehicle without the need to stop the vehicle. The above object is enabled by a transponder system in accordance with a second embodiment of the invention that records or otherwise keeps track of the number of hours the motor vehicle has been driven and, further, is adapted to transmit the accumulated drive time log using a radio frequency signal in response to an activation or query signal generated by a second communication unit carried by the law enforcement or regulatory personnel. In effect, the law enforcement and regulatory personnel can electronically "tap" the log information collected by the first communication unit or transponder disposed in the motor vehicle without stopping the vehicle.

The above object is enabled by a transponder system in accordance with a second embodiment of the invention that stores or otherwise compiles a record of the actual number of hours the motor vehicle has been driven and, further is adapted to selectively transmit the accumulated drive time log using a radio frequency signal in response to an activation or query signal generated by a second communication unit carried by the law enforcement or regulatory personnel. In effect, using the second preferred embodiment of the invention, the law enforcement and regulatory personnel can electronically "tap" the log information collected by the first communication unit or transponder disposed in the motor vehicle without stopping the vehicle.

SUMMARY OF THE INVENTION

The present invention includes, in a first embodiment, an accident response radio identification system for use with vehicles carrying hazardous loads for identifying the loads to safety personnel when the vehicle is involved in an accident. The identification system includes first, and second communication units for identifying the loads to the safety personnel. The first communication unit is adapted to be carried by a motor vehicle holding a hazardous load. It includes means for selectively transmitting information describing the hazardous load in response to receiving an activation signal generated by the second communication unit. Further, the second communication unit is adapted to convert the information describing the hazardous load received from the first communication unit into a first form intelligible by human safety personnel.

In another embodiment of the invention, a system is provided for use with a motor vehicle for compiling logistical information relating to an accumulated time the motor vehicle is driven. In its preferred form, the logistics system includes a first electronic unit adapted to be carried by the motor vehicle. Further, the system includes a memory unit in the first electronic unit for storing driving log information. A sensor is operatively connected to the first electronic unit for sensing movement of the motor vehicle and generating a vehicle moving signal when the movement is sensed. Lastly, the preferred logistical system includes a control unit in the first electronic unit for receiving the vehicle moving signal from the center and converting the vehicle moving signal into vehicle operation information and storing the vehicle operation information in the memory unit as the driving log information. Preferably, the logistical system includes a second electronic unit for selectively generating the activation signal and receiving the driving log information from the first electronic unit. In its preferred form, the second electronic unit is adapted to convert the driving log information into a first form intelligible by humans.

Overall, the embodiments of the subject invention essentially include a responder that is adapted for connection onto a motor vehicle. The responder is activated by a radio signal generated from an officers receiver unit and, once activated, is adapted to transfer information to the officers receiver via radio frequency signals. Preferably, the information relates to the load carried by the vehicle or, alternatively, operations i.e. driving log, of the vehicle.

In one embodiment of the invention, the system includes a responder that is programmable by the motor vehicle carrier using a keyboard or the like. In that mode, the carrier essentially programs the responder with the name of the hazardous material or code information relating to the hazardous material that is being transported by truck, rail, or other vehicle. The subject invention is not limited, however, to information regarding the hazardous material but, rather, is also adapted to include programed information in the responder relating to the name of the carrier hauling the hazardous material, their address, phone number, and a contact person at the carrier who is responsible for the load. Preferably, the system uses radio frequency burst technology for data transmission.

The officers receiver portion of the system is preferably hand held. However, the officers receiver is not limited to being hand held but, alternatively, can be integrated directly into or as part of the emergency vehicle equipment. When a vehicle carrying hazardous material is involved in an accident, personnel such as police or safety officers who happen upon an accident carrying the officers receiver activate same to generate an activation signal that is in turn received by the responder. The activation signal, when received by the responder, activates same. In response to receiving the activation signal, the responder is adapted to send the code identifying hazardous material within the vehicle, company name, telephone numbers, and a contact person. The officers receiver preferably includes a database that is accessed based upon the hazardous material identification code sent from the responder. The database includes a set of information relating to the hazardous material that is used to alert safety or police officers of the danger of the hazardous material, any precautions that should be taken based upon the type of material, and how the hazardous material is to be properly disposed of. Further, the database is adapted to further include a list of public agencies and personnel who are to be contacted to help with the removal of the hazardous material. In an alternative form, the officers receiver is adapted to automatically notify, via satellite, cellular phone, or the like, Hazmat teams, EPA, DOT, etc.

In another embodiment of the subject invention, the responder is adapted for connection to the motor vehicle engine, drive train, or wheels in order to sense when the motor vehicle is moving. Preferably, a sensor is used to track the time, speed, and duration during which the vehicle is moving. The responder includes a control unit that is adapted for connection to the sensor for converting the sensor information into driving record log information that is in turn used to compile a driving record log. In one form, the system enables law enforcement agencies and regulatory personnel to electronically "tap" into this information from a distance using radio frequency signals to determine whether the driver has been driving over the maximum permitted limit. Preferably, the responder includes a memory unit and timer that are adapted to interface with the control unit in order to calculate and then compile a record of the time in which the vehicle is actually moving. The driving record log is stored in a memory so that law enforcement personnel or regulatory authorities equipped with the officers receiver could access this information in a manner similar to that described above in connection with access to the hazardous material information.

Essentially, the law enforcement or regulatory officers receiver is adapted to send out an activation signal to the responder unit on the vehicle. The responder unit is adapted to interpret the activation signal and send back to the officers receiver the information contained in the memory regarding the number of hours the vehicle has been moving. In the preferred embodiment, the information is transmitted using radio frequency burst technology transmission.

The information stored in the memory is also used, in another embodiment, directly by the driver in order to generate a driving log more easily. Preferably, the system automatically completes the driving log.

In another form, the responder in the vehicle is equipped with a global positioning system that is adapted to retrieve information from global positioning satellites in order to track the vehicle's location relative to the fixed satellites and the earth. Accordingly, when the vehicle is moving, the responder retrieves the global positioning satellite information, calculates its position, and then stores the position in memory together with clock information. In one form, the responder calculates position and speed over a predetermined period such as, for example, every fifteen minutes. Thus, an accurate log is maintained with few minor inputs from the truck driver. As noted above, law enforcement and regulatory personnel have access to the electronic driving record and electronically "tap" into the data by sending the activation signal to the responder and then reading the driver record log sent back to the officers transmitter. Therefore, the law enforcement personnel can ensure that the truck driver has not driven over his specific number of hours required by law.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof, and wherein.

DETAILED DESCRIPTION OF THE PREFERRED EMBODIMENTS

Figure 1:
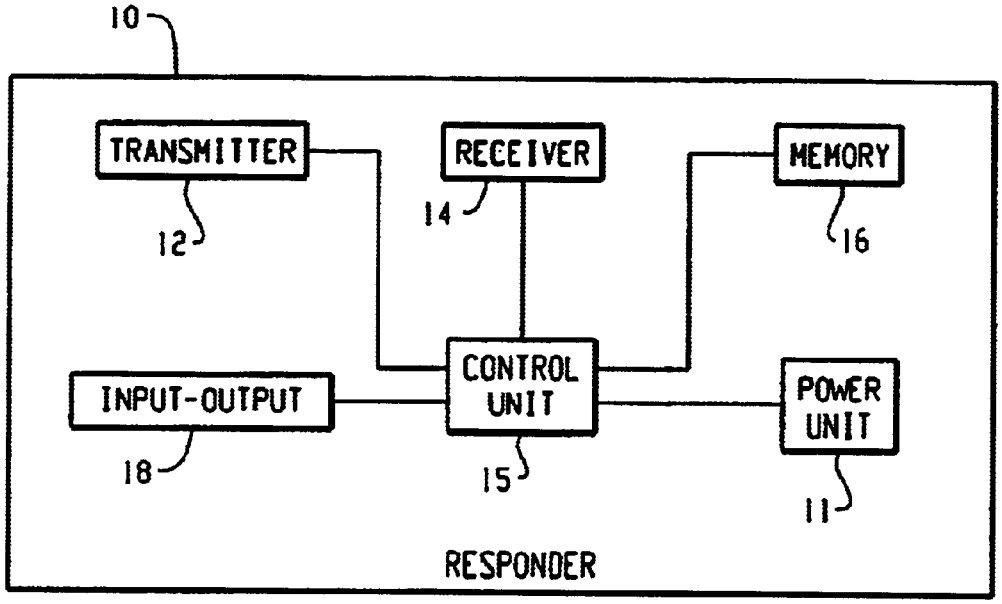
FIG. 1 is a block diagram of a first communication unit portion of the transponder system in accordance with a first preferred embodiment of the invention.
Figure 2:
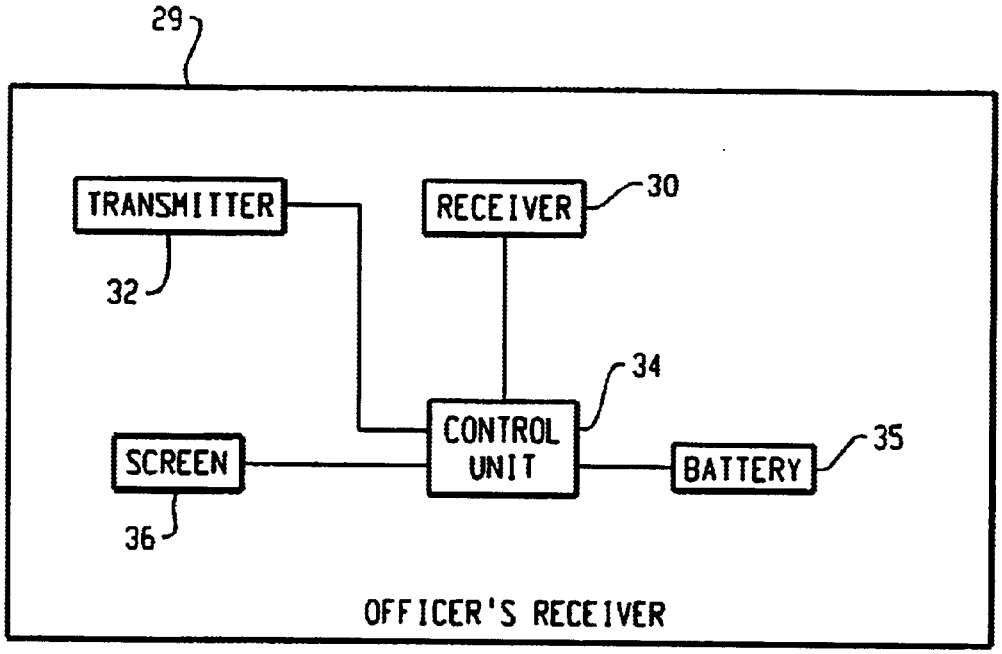
FIG. 2 is a block diagram of a second communication unit portion of the transponder system in accordance with the first preferred embodiment of the invention.

Referring now to the drawings wherein the showings are for the purposes of illustrating the preferred embodiments of the invention only and not for purposes of limiting same, FIGS. 1 and 2 illustrate a first embodiment of the object transponder system in block diagram form. The preferred components of the first and second communication unit portions 10, 29, are shown in those FIGURES, respectively.

Turning first to FIG. 1, the first communication portion of the subject transponder system of the invention includes a responder 10 adapted to be disposed, located, or otherwise attached to a motor vehicle transporting a hazardous load. As shown in the figure, the transponder 10 includes a radio frequency transmitter 12 and a radio frequency receiver 14. In accordance with the first preferred embodiment of the invention, the receiver 14 is used solely to activate the transmitter 12 within the responder 10. Preferably, the transmitter 12 uses burst technology to transfer data to the second communication unit (FIG. 2).

With continued reference to FIG. 1, the responder further includes a control unit 15 operatively connected to a power supply 11. Preferably, the power supply 11 includes one or more batteries (not shown) but could be equivalently connected to a source of power derived from the vehicle transporting hazardous load material. The transmitter 12 is also operatively connected to the control unit 15 which is in turn operatively connected to a memory unit 16. Lastly, an input/output interface 18 is provided in the responder 10 and is operatively connected to the control unit 15.

In accordance with the first preferred embodiment of the invention, information relating to the hazardous material is inputted into the control unit 15 through the input/output interface 18 by the shipping company that is shipping the hazardous material. The control unit 15 is adapted to store the information into the memory unit 16 as it is received through the input/output interface 18. Preferably, the information includes one or more codes relating to the hazardous material and may also include the name, address, telephone number, and a contact person at the company shipping the hazardous material so that one or more experts can be easily contacted and recruited for assistance in the event of a roadway accident. However, those skilled in the art will recognize that any other information relating to the hazardous material can be placed into the memory unit 16 as well.

As shown, a receiver 14 is operatively coupled to the control unit 15. Preferably, the receiver 14 is a radio frequency receiver and is adapted to respond to a radio frequency activation or query signal transmitted from the second communication unit (FIG. 2) which will be described below. In accordance with the first preferred embodiment of the invention, the receiver 14 is adapted to generate a signal, (preferably a logical signal) to notify the control unit 15 that an activation signal was received by the receiver 14. In turn, the control unit 15 is adapted to activate the responder 10. After the responder 10 is activated, the system begins transmitting the information contained in the memory unit 16 through the radio frequency transmitter 12. To do this, the control unit 15 reads the information contained in the memory unit 16 and transfers the information into a buffer in the transmitter 12 to be transmitted via radio frequency to the outside world.

Figure 3:
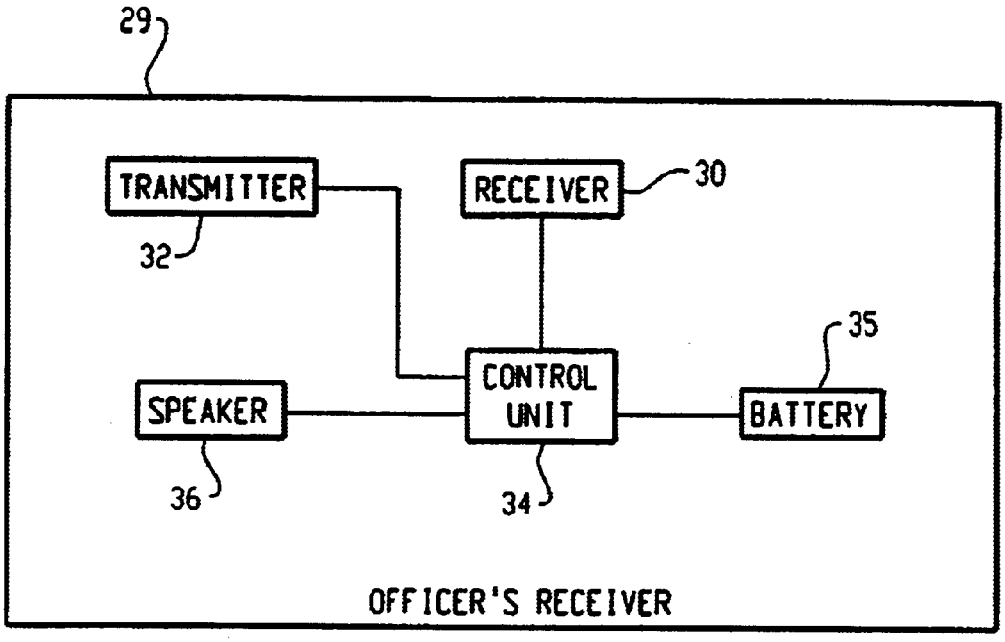
FIG. 3 is a block diagram illustrating an alternative form of the second communication unit shown in FIG. 2 including a speaker for producing audible in formation.

The second communication unit is illustrated in FIG. 2 in block diagram form. Turning now to that figure, the second communication unit includes a portable receiver 29 that is adapted to travel with police officers or other safety personnel. Preferably, as shown, the portable receiver 29 includes both a radio receiver unit 30 and a radio transmitter unit 32. As with the responder 10, the radio receiver and transmitter units 30, 32 are operatively connected to a control unit 34. In the preferred embodiment of the invention, the portable officer receiver 29 includes a screen for displaying information that is received into the receiver 29 from the transponder 10 described above in connection with FIG. 1. As an alternative, the officer receiver 29 is provided with a speaker 40 such as shown in FIG. 3 for developing audible information that can be easily heard by police officers or safety personnel within earshot of the portable receiver 29. In that alternative, the control unit 34 is adapted to transmit information received from the transponder 10 to the police officer or safety personnel via audio signals. Those skilled in the art will recognize that the portable receiver 29 may derive power from several sources and in several manners such as, for example, from an automotive car battery such as from a police cruiser. However, in accordance with the preferred embodiment of the invention, the portable receiver 29 is powered by a set of self-contained batteries 35.

Operationally, when a police officer or safety personnel happens upon a hazardous material spill, the officer activates the portable receiver 29 which in turn activates the radio transmitter 32 for sending a radio signal or code to in turn activate the responder 10 (FIG. 1). Preferably, the radio transmitter unit 32 is adapted to generate and transmit a particular activation or query signal that is recognized by the responder unit 10 as a polling signal. The responder 10 is thereby activated. As described above, the responder, once activated, is adapted to read information from the memory unit 16 and transmit the information via radio frequency signal through the transmitter 12 to the outside world. In turn, the portable officers receiver 29 receives the signal and data contained therein through the receiver portion 30 and, in turn, displays the information on the display screen 36 or, alternatively, "plays" the information on a speaker unit 40. Thus, overall, the portable officers receiver 29 is adapted to generate an activation or query signal and then wait for a response from the responder 10. The response is in the form of data or other information relating to the hazardous cargo material. Conversely, the responder 10 is adapted to remain idle until the receiver 14 receives the activation or query signal from the portable officers receiver 29. Thereafter, the control unit 15 is activated for communicating the data contained in the memory 16 to the transmitter 12 for conversion into a radio frequency signal for reception by receiver 30 of the officers receiver 29.

Figure 4:
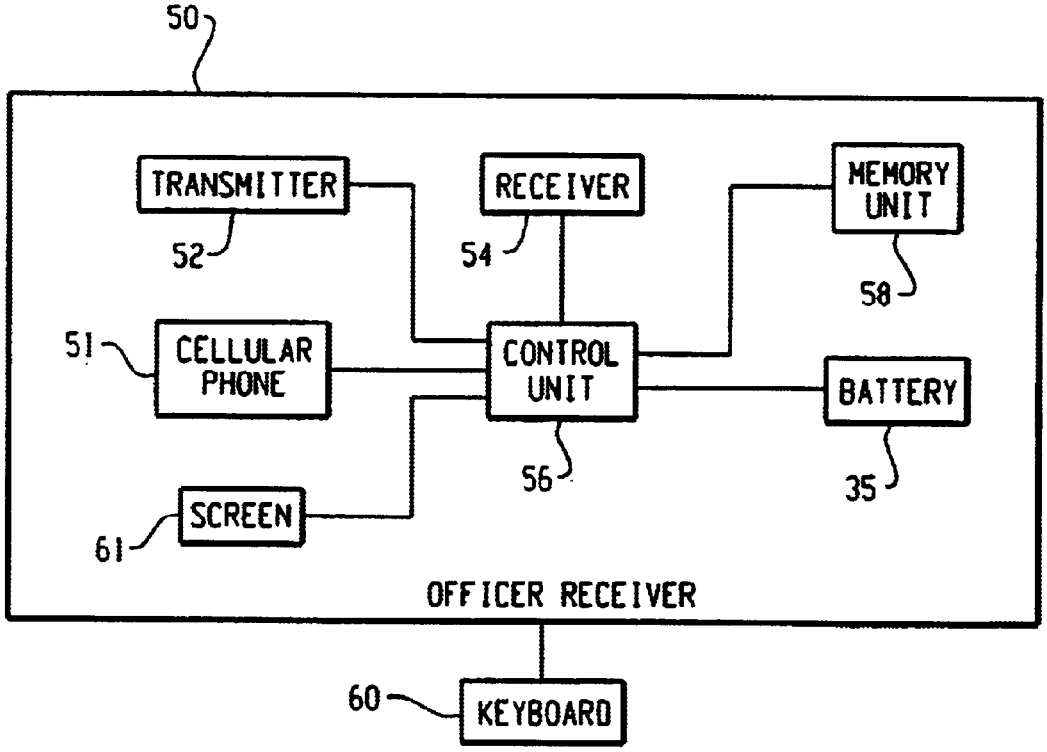
FIG. 4 is a block diagram illustrating an alternative form of the second communication unit shown in FIG. 2 including a keyboard and cellular phone for inputting information and communicating with remote personnel, respectively.

FIG. 4 shows an alternative embodiment of the portable receiver 50 in block diagram form. Turning now to that figure, the receiver 50 is integrated into a computer and telephone system. More particularly, the receiver 50 includes a radio transmitter 52, a radio receiver 54, a control unit 56, and a battery 35. However, in the alternative embodiment shown in FIG. 4, the control unit 56 is preferably a microprocessor operatively connected to a large sophisticated database contained in a memory unit 58. Further, the microprocessor may be connected "on line".

Operationally, when information relating to the hazardous material is received from the responder 10 into the portable receiver 50, a keyboard 60 is used to retrieve information from the database in the memory unit 58 for display on screen 61. In that way, information relating to the hazardous material is displayed within the police officer or safety personnel vehicle.

In addition to the above, the alternative portable receiver 50 includes a cellular phone 51 to enable officers and safety personnel to contact other personnel whose name, addresses, contact phone numbers and the like are contained in the database of the memory unit 58. Further, the system 50 is adapted to go "on line" using the sophisticated microprocessor of the control unit 56 to retrieve additional information regarding the hazardous material.

As is well understood in the art, the officers receiver 50 can be powered from several sources and in several manners such as, for example, from a car battery. However, in the preferred embodiment, the receiver 50 is powered by a self-contained set of batteries 35.

Further, the responder 10 of the subject transponder system is preferably disposed, located, or otherwise attached to the vehicle transporting the hazardous load in a manner that the transponder 10 will be unaffected by the accident and, in that way, will remain in operable condition during and after the roadway accident.

Figure 5:
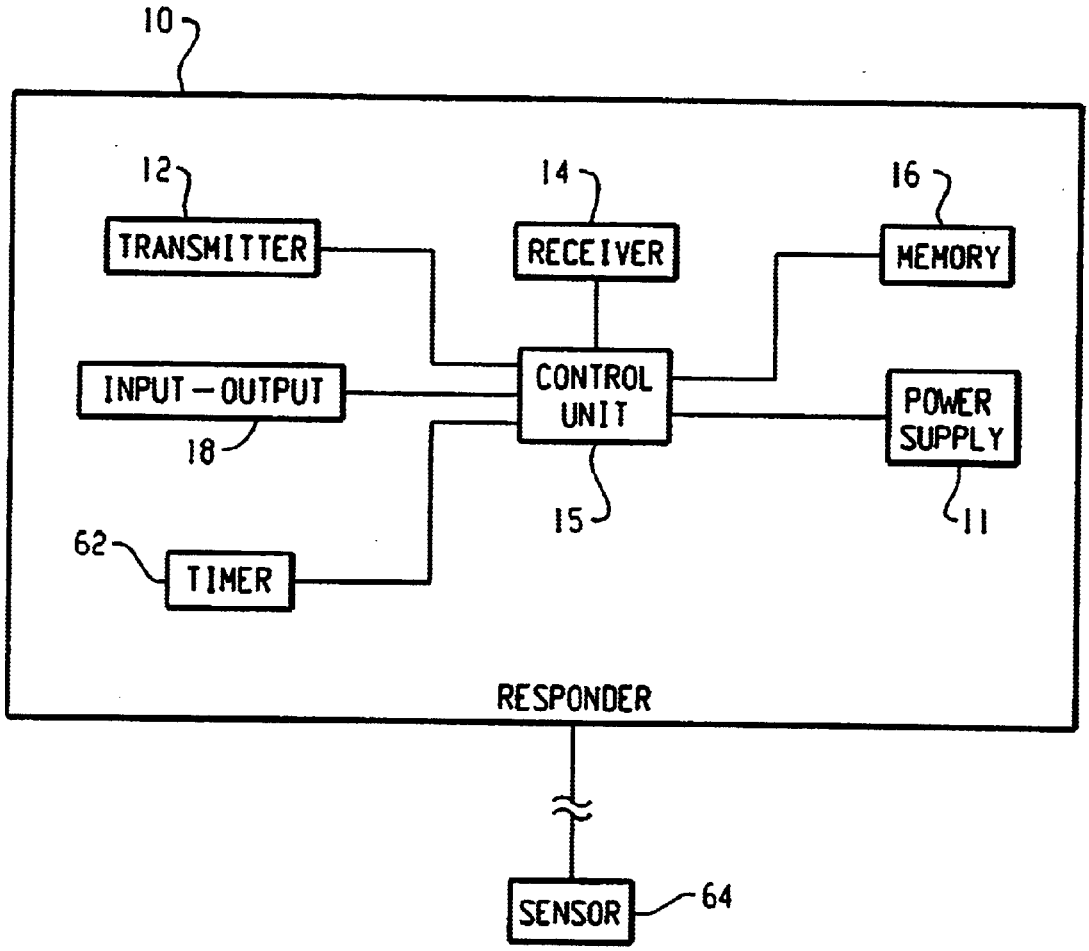
FIG. 5 is a block diagram illustrating an alternative form of the first communication unit portion of the subject transponder system including a sensor for monitoring motor vehicle motion and movement activity in accordance with a second preferred embodiment of the invention.

Turning now to FIG. 5, a second preferred embodiment of the invention is illustrated in block diagram form. Referring now to that figure, the first communication unit portion of the subject transponder system includes a first communication unit in the form of a responder 10 that is adapted to not only transmit information relating to the hazardous materials carried by the transport vehicle, but is further adapted to record the accumulated time during which the vehicle is moving and selectively transmit this logged information to second communication units carried by regulatory enforcement authorities.

In the embodiment shown in FIG. 5, the responder 10 includes a receiver 14, a radio transmitter 12, a control unit 15, a power supply 11, and a memory unit 16 that have the form and function substantially as described above in connection with the first preferred embodiment of the subject transponder system. In addition, however, a sensor 64 is operatively connected to the control unit 50 within the responder 10 as shown. Preferably, the sensor 64 is attached to the wheels or drive train of the hazardous material transport vehicle to determine when they are turning or when the vehicle is moving. Alternatively, the sensor 64 may be attached to any suitable location on the vehicle to drive a signal indicative of vehicle movement. As an example, the sensor 64 can be operatively connected to the engine to determine when the vehicle is moving or to one or more of the digital computers associated with the motor vehicle engine or other motor vehicle control functions. Still further, a timer 62 is operatively connected to the control unit in order to best determine how long the vehicle is in motion.

Operationally, the sensor 64 senses that the vehicle is moving and transfers the information via the control unit 15 into the memory unit 16 together with information from the timer 62. Preferably, the timer 62 selectively starts running when the vehicle is placed in motion and then continues to run until the vehicle is stopped whereupon the timer 62 transfers the accumulated time toll information, via the control unit 15, into the memory unit 16 for storage and later retrieval. The information stored in the memory unit 16 is a representation of the accumulated time in which the truck or hazardous material transport vehicle has been driven.

Figure 6:
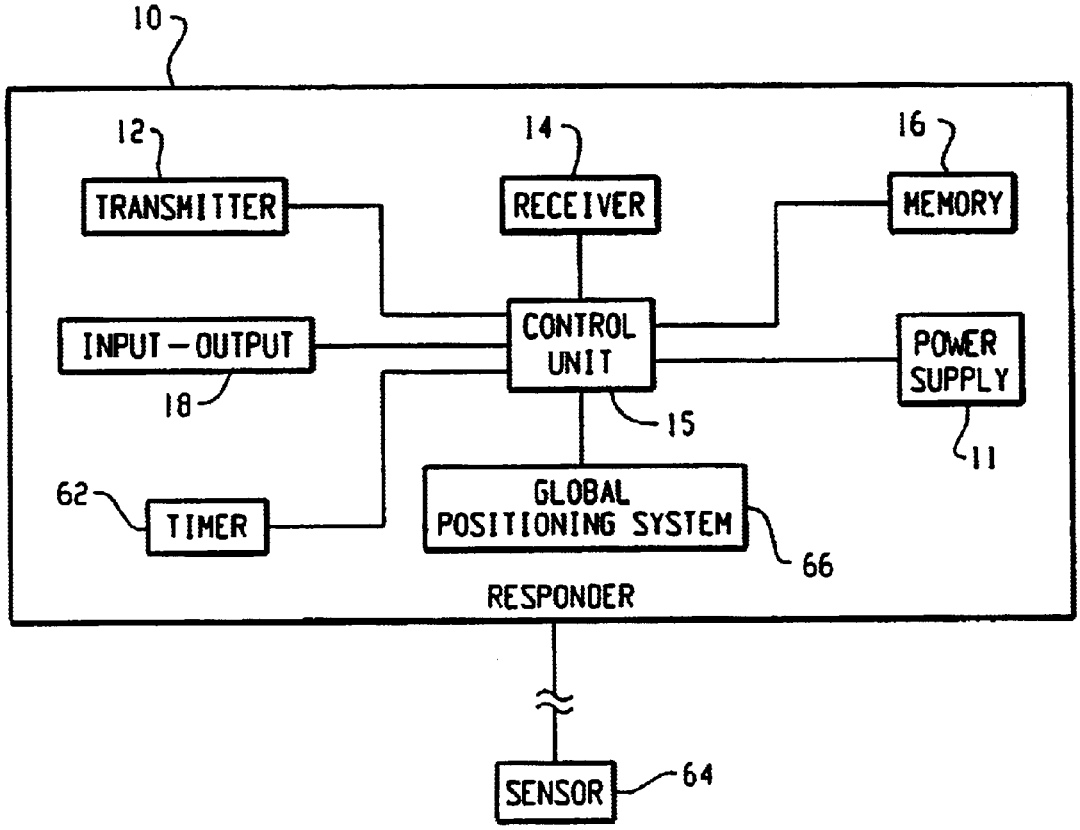
FIG. 6 is a block diagram illustrating an is alternative form of the first communication unit portion of the subject transponder system shown in FIG. 5 including a GPS sensor; and, FIG. 7 is a block diagram illustrating a driver's receiver unit in operative communication with the first communication unit portion of the transponder system in accordance with the second preferred embodiment of the invention.

FIG. 6 illustrates yet another alternative embodiment wherein the responder 10 includes all of the functional units described above in connection with the first and alternative embodiments, but, in addition, includes a global positioning system 66. The global positioning system is adapted to receive information from global positioning satellites and generate information relating to the location of the vehicle relative to the satellites and landmarks on earth. The vehicle position information is transferred into the memory unit 16 via the control unit 15. The position of the vehicle together with time information from a clock is combined to compile a suitable vehicle travel log history.

In order for law enforcement or regulatory authorities to download or otherwise access the vehicle location information stored in the memory 16, an activation or query signal is generated using a portable receiver 29, 50 substantially in a manner described above in connection with the first preferred embodiment. The portable receiver, when actuated, transmits a decoding signal which is received by the receiver 14 in the responder 10. In response to the activation signal, the responder 10 retrieves the vehicle position information from the memory 16 using the control unit 15 and transmits same using transmitter 12 to the officers receiver 29. Preferably, the receiver 29 includes a transmitter 30, receiver 32, control unit 34, battery 35, and a screen display 36.or speaker 40 such as, for example, shown in the embodiments illustrated in FIGS. 2 and 3. As described above in connection with the previous embodiments, operationally, an activation or query signal is generated when law enforcement officers activate the portable receiver 29, 50 which in turn activates the responder 10. In accordance with the second preferred embodiment of the invention shown in FIG. 6, the responder 10 is adapted to transmit information related to the accumulated time in which the truck or hazardous load vehicle has been driven. This information transmitted from the transmitter 12 is received into the receiver 30, 54 of the portable receiver 29, 50, respectively.

Figure 7:
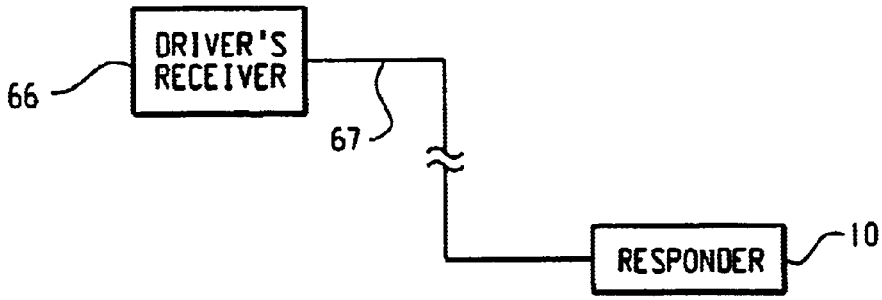

A drivers receiver 66 is illustrated in FIG. 7 and provides an auxiliary device for readily and easily generating a travel log that reflects the accumulated driving time of the truck or hazardous load vehicle carrying the responder. Whenever the vehicle driver wishes to make a hard copy record of his travel log, he merely downloads the information from the responder 10 into the drivers receiver 66. Preferably, the information downloaded reflects the time driven and the location of the vehicle during travel. The vehicle receiver 66 is preferably a computer or printer that is adapted for interface with the transponder 10 using, for example, a communication wire 67 such as shown in FIG. 7 or, alternatively, an electromagnetic radiation communication link (not shown). The vehicle receiver 66 is adapted to download the travel log information reflecting the places where the vehicle has been and how far it has traveled. This information can easily be turned into a log with a few comments from the driver.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. A system for use with a motor vehicle for compiling logistical information relating to an accumulated time the motor vehicle is driven, the system comprising:

a responder device adapted to be carried by the motor vehicle, the responder device including:

a first radio frequency receiver for receiving an activation signal from an operatively associated source; and a first radio frequency transmitter for selectively transmitting driving log information in response to receiving said activation signal;

a memory unit for storing said driving log information;

a sensor operatively connected to the responder device for sensing movement of the motor vehicle and generating a vehicle moving signal when said movement is sensed;

a control unit in the responder device for receiving said vehicle moving signal from said sensor and converting the vehicle moving signal into vehicle operation information and storing the vehicle operation information in said memory unit as said driving log information; and, a portable receiver device for selectively generating said activation signal and receiving said driving log information from the responder device, the portable receiver device being adapted to convert the driving log information into a first form intelligible by humans and including a second radio frequency transmitter for selectively generating said activation signal and transmitting said activation signal to said responder device; and, a second radio frequency receiver for receiving said driving log information.

2. The system according to claim 1 wherein said sensor is adapted for operative connection to a one of tires of the motor vehicle, an engine of the motor vehicle, and a computer control unit of the motor vehicle.

3. The system according to claim 1 wherein said sensor is a global positioning system adapted to determine a position of the motor vehicle relative to a set of associated satellites and landmarks on earth.

4. The system according to claim 1 further including a drivers receiver unit in selective operative communication with said responder device for retrieving said driving log information from the responder device and generating a human readable driving log based on the retrieved driving log information.

5. The system according to claim 1 wherein the responder device is adapted to selectively transmit said driving log information from the memory unit in response to receiving an actuation signal from an operatively associated source.

6. The system according to claim 5 further including a second electronic unit for selectively generating said activation signal and receiving said driving log information from the first electronic unit, the second electronic unit being adapted to convert the driving log information into a first form intelligible by humans.

7. The system according to claim 1 wherein the responder device is adapted for use with vehicles carrying hazardous loads for identifying the loads to safety personnel when the vehicle is involved in an accident, the responder device being adapted to selectively transmit information describing the hazardous load in response to receiving said activation signal from said electronic unit.

8. The system according to claim 7 wherein the portable receiver device is adapted to convert the information describing the hazardous load into a visual display intelligible by human safety personnel.

9. The system according to claim 7 wherein said portable receiver device is adapted to convert the information describing the hazardous load into an audible form intelligible by the human safety personnel.

10. The system according to claim 7 wherein said memory unit in said responder device is adapted to store said information describing the hazardous material including at least a one of a name of the hazardous material, a code associated with the hazardous material, safety information related to the hazardous material, information on a motor vehicle carrier company responsible for carrying said hazardous load, and information on a contact person responsible for said vehicle carrying the hazardous load.

11. The system according to claim 7 wherein:

the memory unit of said responder device is adapted to store a hazardous material identification code and selectively transmit the identification code as said information describing the hazardous load in response to receiving said activation signal from said portable receiver device; and, said portable receiver device includes a second memory unit adapted to store a database relating a plurality of hazardous material identification codes with a corresponding plurality of set of information describing the hazardous load including at least a one of a name of the hazardous material, safety information relating to the hazardous material, information relating to a carrier company responsible for said vehicle, and information on a contact person responsible for said hazardous load.

12. The system according to claim 11 wherein said electronic unit is adapted to retrieve one of said plurality of sets of information from said memory unit based on said identification code transmitted by the first electronic unit and convert the retrieved one of the plurality of sets of information into said first form intelligible by human safety personnel.

* * * * *